United States Patent [19]

Deith

[11] 4,199,739

[45] Apr. 22, 1980

[54] LIQUID WETTED SWITCHING ELEMENT

[75] Inventor: John Deith, Holmdel, N.J.

[73] Assignee: C. P. Clare and Company, Chicago, Ill.

[21] Appl. No.: 855,240

[22] Filed: Nov. 28, 1977

[51] Int. Cl.[2] ..... H01H 1/08

[52] U.S. Cl. ..... 335/58; 335/47

[58] Field of Search ..... 335/47, 48, 49, 51, 335/52, 55, 56, 57, 58, 81, 79, 180, 192, 196, 153; 200/191, 192, 209, 210, 226, 234

[56] References Cited

U.S. PATENT DOCUMENTS

| | | | |
|---|---|---|---|
| 3,366,902 | 1/1968 | Grobe | 335/153 |
| 3,643,185 | 2/1972 | Zimmer | 335/58 |

*Primary Examiner*—Harold Broome

*Attorney, Agent, or Firm*—Silverman and Gandhi

[57] ABSTRACT

The present invention comprises an armature suspended within a resilient means, wherein the resilient means also performs a capillary function in that a wetting agent, such as mercury, forms a captive reservoir which travels upon said resilient means to said armature and thereby performs a self-renewing wetting function with regard to the contact surfaces of said armature. The armature and resilient means are enclosed within an envelope. The envelope has secured therein one or more contacts which interact with the contact surfaces of the armature (in response to an electromagnetic stimulus) and are continually wetted by said interaction.

11 Claims, 4 Drawing Figures

LIQUID WETTED SWITCHING ELEMENT

BACKGROUND OF THE INVENTION

The present invention relates generally to electronic switching elements, and more particularly to relay type elements employing conductive liquid contact surfaces.

Liquid contact relays are known, the liquid employed being generally, though not exclusively, mercury or a metallic mixture having mercury as its major element. In the following description, mercury is specified as the preferred conductive liquid but without intention of being limited to either a mercury mixture or to pure mercury. Other conductive liquids may be substituted therefore.

The present switching element employs a sealed envelope, within which are located conductive elements, at least one of which is moveable. Sealed within said envelope is a quantity of mercury. Means are provided for suspending a moveable element, hereinafter termed an armature, in order to make and break an electrical circuit including at least one of said conductive elements. Means are also provided for maintaining the mercury, or other conductive liquid, intermediate the contacts when a contact is made. Separation of the contact elements is accompanied by a breaking of the electrical circuit through the mercury.

A conventional mercury relay employs a pool of mercury as a reservoir, and attempts to maintain mercury between the contacts by replenishment from the pool by one means or another. For example, capillary action may be employed.

It is an object of the present invention to employ such capillary action, however, without the use or existence of a pool of mercury.

It is another object to provide a means of capillary movement which is based upon the surface tension between the mercury and the abutting spring and contact surfaces of the relay.

It is a further object of the present invention to combine in a single element the function of supporting said armature into a correct position and with a proper degree of resilience, while providing the appropriate capillary action required to maintain a sufficient wetness of the armature and its contact surfaces.

SUMMARY OF THE INVENTION

The present invention comprises an attitude insensitive relay secured within an hermetically sealed enclosure, said relay having an internal spiral spring and an armature medially mounted within said spiral spring. Said spring is mercury wettable and is thus covered by a thin layer of mercury. The total quantity of mercury is insufficient to form a freely flowable permanent pool, regardless of any possible attitude of the relay.

DETAILED DESCRIPTION OF THE INVENTION

Figure 1:
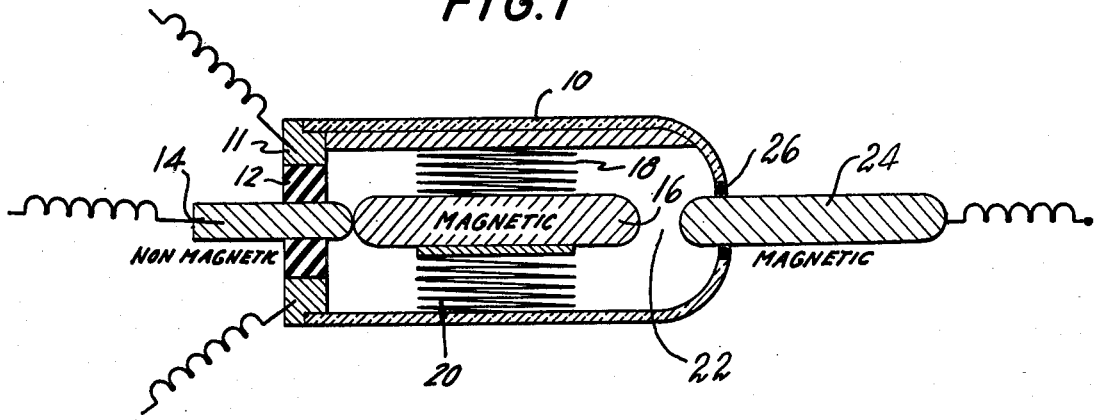
FIG. 1 is a cross-sectional schematic view of one embodiment of the present invention.

FIG. 1 illustrates a housing 10 having a first end 11 in which an annular insulating plug 12 is disposed. Within said plug 12 is mounted a first contact, hereinafter referred to as the normally closed (N.C.) contact 14 the armature 16 is connected electrically to an external circuit through said first end 11.

Resiliently suspended within said housing 10 is an armature 16. The suspension of said armature is achieved by virtue of a helical spring 18 and a wire 20 which serves to position the spring 18. The spring 18 is preferably of the flat wound type. The large surface area of the loops of such a spring possess a sufficiently high level of surface tension in order to accommodate a capillary movement of mercury along its surface. It is noted that the armature 16 is suspended along the horizontal axis of the envelope 10 such that the left and right ends of said armature are aligned with the axis of N.C. contact 14 and a contact 24, hereinafter referred to as the normally open (N.O.) contact 24.

In FIG. 1 it may be seen that a gap 22 exists between said armature 16 and said N.O. contact 24. The width of this gap is one of the controlling factors in determining the level of magnetic flux which is required in order to achieve a closure of the switch.

Circumferentially surrounding the interface between said contact 24 and said envelope 10 is a glass-to-metal seal 26.

Enclosed within the envelope 10 is a quantity of mercury which is held captive by the spring 18. The quantity of captive mercury must be such as to remain wholly disposed upon the spring's surface areas, the interior surfaces of the contacts 14 and 24, and on the armature 16. The mercury will, by virtue of its natural affinity for any metallically wetted surface, be attracted from the spring to the armature 16 and, therefrom, to the mutual contact surfaces between elements 14, 16 and 24. This phenomenon will insure a suitably wetted contact surface at all times. The effectiveness of the spring as a carrier of mercury can be increased by plating its surface with chrome or any other comparable metallic wetting agent. It is noted that, where an appropriate wetting agent is used, considerable mercury can be carried within a miniscus that forms within the spiral of the spring. Hence, such a miniscus will, in effect, form a channel through which the mercury can move up and down the spring in order to re-supply the contact surfaces. Through such a re-supply, the primary purposes of the present invention, namely eliminating the existence of bounce and chatter in the switching function of a relay and achieving a low and constant contact resistance (e.g., 30 milliohms) are effectively achieved.

As to the physical operation of the switching function of the present invention, it can be appreciated that as the intensity of a magnetic field to which the armature is exposed changes, the degree of attraction between the opposing tips of the armature 16 and N.O. contact 24 will concurrently respond as to their degree of mutual attraction. The strength of the magnetic field which is required in order to close the present switch will be determined by the resilience of the spring 18, the width of the gap 22, and the degree to which elements 16 and 24 are naturally attracted to each other in the absence of any magnetic force.

Figure 2:
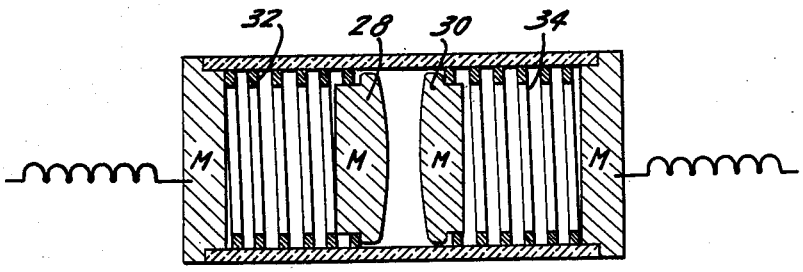
FIG. 2 is a cross-sectional schematic view of a second embodiment of the present invention.

Turning now to FIG. 2, a second embodiment of the present invention is seen. This embodiment utilizes a pair of armatures 28 and 30 which are longitudinally secured within a pair of springs 32 and 34. As in the embodiment of FIG. 1, a sufficient amount of mercury is introduced into the envelope in order to create a capillary movement of mercury upon a miniscus that is formed within the spiral of the spring. Hence, as in the previous embodiment, the springs serve as both a wick and a biasing element for the armatures 28 and 30. Said armatures will close in response to a magnetic flux of a sufficient level. Electrical contact from the armatures to the contacts is achieved by the springs themselves.

Figure 3:
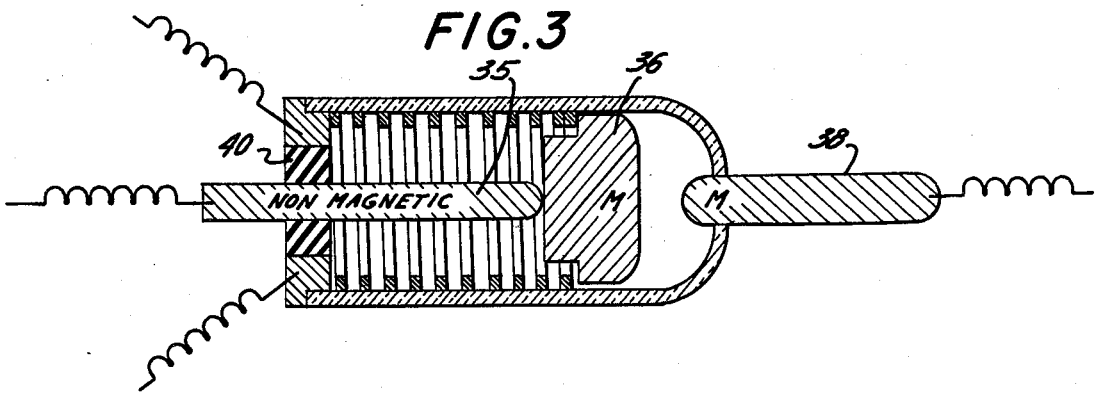
FIG. 3 is a cross-sectional schematic view of a third embodiment of the present invention.

In FIG. 3 is shown a third embodiment, illustrating one manner in which the present invention may be utilized as a (Form C) single pole double throw switch. A normally closed contact 35 is provided, which contact normally touches an armature 36. As in the embodiment of FIG. 1, an insulation plug 40 is provided which surrounds the N.C. contact 35. A normally open contact 38 is positioned at the right end of the envelope. The double pole function of the present embodiment is obtained by the longitudinal movement of the N.C. contact 35 within the left side of the envelope. Where the N.C. contact 35 is displaced to the left, thereby taking it out of contact with the armature 36, a condition will exist in which the armature serves as the pole of a single pole double throw switch.

It is to be noted that through the use of a pair of elongated contacts, similar to contact 35, the embodiment of FIG. 2 could easily be adapted into a double pole, double switch.

Figure 4:
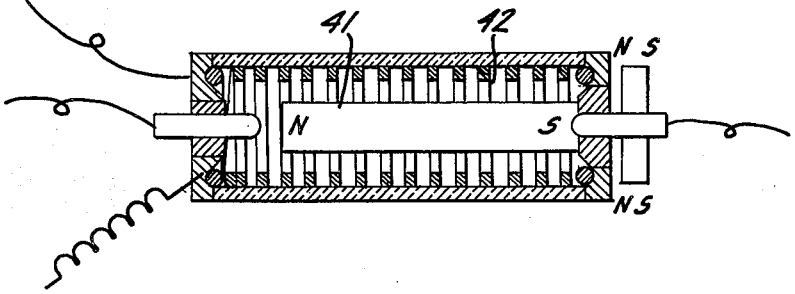
FIG. 4 is a cross-sectional schematic view of a fourth embodiment of the present invention.

Turning now to FIG. 4, a fourth embodiment is seen in which a permanent magnet 41 is mounted within a spring 42. The magnet 41 is preferably coated with a thin layer of plastic, such as ABS, and then plated with a wettable metal. A contact 44 is provided which, upon application of the proper magnetic flux, will make contact with the magnet 41. It is to be appreciated that by the addition of a second contact to the left hand side of the envelope, a Form C switch could be obtained.

It is to be further appreciated that all embodiments of the present switch will operate with dry contacts wherein such dry contacts are preferably coated with noble metals such as rhodium, silver, palladium, cobalt or gold, or alloys thereof.

It is thus seen that the object of obtaining an improved electronic switching element has been efficiently attained by the above-described embodiments of the present invention.

While there have been herein shown and described the preferred embodiments of the present invention, it will be understood that the invention may be embodied otherwise than as herein specifically illustrated or described and that within said embodiments certain changes in the detail and construction, and the form of arrangement of the parts may be made without departing from the underlying idea or principles of this invention within the scope of the appended claims.

Having thus described my invention, what I claim as new, useful, and non-obvious and accordingly secure by Letters Patent is:

1. A liquid-wetted switching element, including an hermetically sealed envelope in a housing, comprising:

(a) a first armature, formed of an electromagnetically sensitive material;

(b) means for resiliently supporting said armature within said envelope, said resilience means having a metallically wetable surface, said means electrically connected to said envelope;

(c) an electrically conductive wetting agent, said agent being attracted to the surfaces of said resilient means and said armature, said wetting agent being sealed within said envelope, and (d) a pair of contacts proximately mounted to said armature within said housing, whereby an electromagnetic flux of sufficient magnitude will move said armature a pre-determined distance towards one of said contacts, therein completing an electrical circuit.

2. The switching element as recited in claim 1 in which said envelope comprises a member disposed transversely at one end of said resilience means in which said member also serves to support and position said resilience means.

3. The switching element as recited in claim 1 in which said switching element further comprises a normally closed contact, in between said armature and one of said contacts, insulatingly secured within said envelope, wherein the said electromagnetic flux of sufficient magnitude will displace said armature from said normally closed contact, thereby opening the electrical circuit.

4. The switching element as recited in claim 3 in which said switching element further comprises a normally open contact, said normally open contact displaced from one end of said armature by a gap, wherein an electro-magnetic flux of sufficient magnitude will cause said armature to be displaced out of contact with said normally closed contact and into contact with said normally open contact, thereby completing an electrical circuit through said normally open contact.

5. The switching element as recited in claim 1 in which said resilience means comprises a spring.

6. The switching element as recited in claim 5 in which said spring comprises a flat helical spiral spring, said spring having a particular width between adjacent spirals which will permit the formation in said width of a miniscus comprised of said wetting agent, wherein said miniscus will serve as a captive reservoir upon which said wetting agent can move up and down the spring in order to supply the surface of said armature with a coating of said wetting agent, wherein said wetting agent will serve to absorb any low order displacement of said armature wherein such a low order displacement would otherwise create an undesirable low order of electrical intermittancy or interference.

7. The switching element as recited in claim 1 in which said armature comprises a north-south pole magnet.

8. The switching element as recited in claim 7 in which said switching element further comprises a normally open contact, said contact itself comprised of a north-south pole magnet, said normally open contact secured within said envelope in a position displaced by a gap from one pole of said armature, said pole being opposite from the pole of said normally open contact closest to said armature pole, wherein said armature and said contact will close in response to an electro-magnetic flux of sufficient magnitude.

9. The electrical switching element as recited in claim 1 in which said wetting agent is mercury or an alloy thereof.

10. The switching element as recited in claim 9 in which the surface of said resilience means is placed with a metallic agent which will enhance the ease of movement of said wetting agent along said resilience means as well as to and from the contacts of said armature.

11. The switching element as recited in claim 1 in which the quantity of wetting agent sealed within said envelope is insufficient to form a freely flowable permanent pool, regardless of any possible attitude of the switching element.

* * * * *